United States Patent [19]

Cosman et al.

[11] Patent Number: 4,761,656

[45] Date of Patent: Aug. 2, 1988

[54] PASSIVE MARKER DEVICE

[75] Inventors: Armond D. Cosman; Larry R. Cox, both of Austin, Tex.

[73] Assignee: Minnesota Mining and Manufacturing Company, St. Paul, Minn.

[21] Appl. No.: 866,798

[22] Filed: May 23, 1986

[51] Int. Cl.[4] ..... H01Q 1/40

[52] U.S. Cl. ..... 343/719; 343/873; 340/571

[58] Field of Search ..... 343/719, 847, 872, 700 MS, 343/873; 340/571, 572, 568, 573

[56] References Cited

U.S. PATENT DOCUMENTS 3,216,016 11/1965 Tanner ..... 343/719
4,217,468 8/1980 Rice et al. ..... 343/719
4,334,227 6/1982 Marks ..... 343/719
4,633,262 12/1986 Traut ..... 343/700 MS
4,682,180 7/1984 Crans ..... 343/700 MS

*Primary Examiner*—William L. Sikes
*Assistant Examiner*—Doris J. Johnson
*Attorney, Agent, or Firm*—Donald M. Sell; Walter N. Kirn; Robert L. Marben

[57] ABSTRACT

A passive marker device including a tuned circuit enclosed in a housing which includes a base member with an upstanding rim with a cover member bonded to the rim and to a central portion of the base member. An opening is provided that extends through the housing at the central portion of the housing. A boss extends from the central portion of the base member to the cover member. The boss is recessed on the side of the base member that is away from the cover.

4 Claims, 1 Drawing Sheet

PASSIVE MARKER DEVICE

FIELD OF THE INVENTION

The invention presented herein relates to passive marker devices which are selectively placed relative to various portions of buried utilities such as gas, telephone, water and power lines, for use in locating such portions when necessary. The invention relates more particularly to such markers having an inductance-capacitor tuned circuit and the housing structures for such markers.

BACKGROUND OF THE INVENTION

Prior art electronic marker devices are known which have a tuned circuit that is sealed within a plastic envelope. The tuned circuit is made up of a circularly wound coil of wire connected in parallel with a capacitor, with the assembly having a generally toroidal configuration. The plastic envelope has a generally "U"-shaped periphery with the side at the top of the "U" being initially opened and being sealed after the tuned circuit assembly has been inserted.

Another electronic marker device is disclosed in U.S. Pat. No. 4,334,227 to Barry M. Marks which is hoop shaped and includes a mandrel on which the coil for a tuned circuit is wound with a cover band provided to cover the coil. The mandrel has a thin, central web with a center opening in the web which is used for mounting the mandrel to a spindel to facilitate winding of the coil on the mandrel during manufacture of the device.

None of the prior art devices is constructed so it can, if desired, be readily secured to a strip of flexible material for burial with the marker or secured to a flat surface, such as the ceiling of a buried utility vault.

SUMMMARY OF THE INVENTION

The invention presented herein provides a passive marker which avoids the disadvantages found in the prior art devices. It includes a tuned circuit and a housing for the tuned circuit. The housing includes a base member having an upstanding rim and a cover member bonded to the rim and to a central portion of the base member, the central portion of the base member having an opening with the cover member having an opening also which is aligned with the opening in the central portion of the base member.

The central portion of the base member includes a boss which extends in the same direction as the rim. The boss has the opening for the central portion of the base member. The end of the boss and the cover member are bonded together to provide a firm base by which the housing can be secured to a flat surface, such as the ceiling of a buried vault, using a mechanical fastener, such as a stud applied by a stud gun.

Another feature of the housing is forming the boss on the base member so that a recess is presented on the side of the boss that is away from the cover member to reduce the thickness of the material presented by the boss and the cover member minimizing the length required for a fastener used to mount the marker on a flat surface.

BRIEF DESCRIPTION OF THE DRAWINGS

The foregoing feature and advantage of the invention will be apparent from the following detailed description presented in conjunction with the accompanying drawings, wherein.

DETAILED DESCRIPTION

Figure 1:
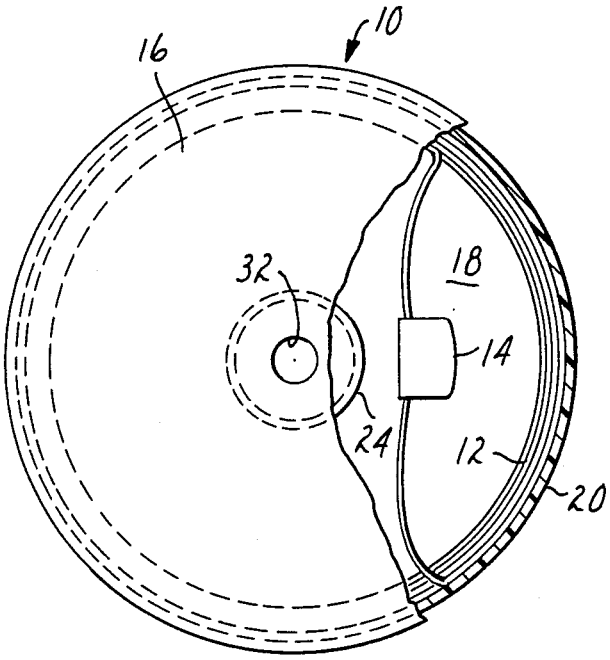
FIG. 1 is a plan view of a passive marker device embodying the invention presented herein with a portion broken away to illustrate interior detail.
Figure 2:
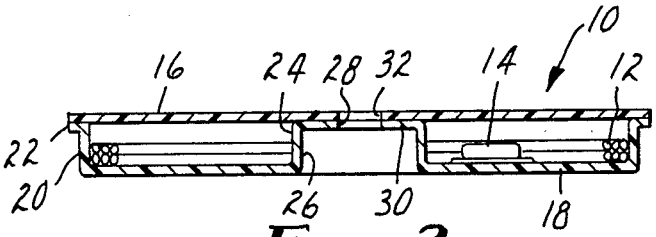
FIG. 2 is a diametrical, cross-sectional view of the passive marker device of FIG. 1.

Referring to the drawings, FIG. 1 of the drawing shows a plan view of a passive marker device embodying the invention with a portion broken away to illustrate interior details. A housing 10 is provided containing a tuned circuit which includes a coil of wire 12 forming an open air inductance with a capacitor 14 connected between the ends of the coil. Additional details of the housing 10 are shown in FIG. 2. The housing 10 is formed from a flat cover member 16 and a base member 18 having an integral upstanding rim or edge 20 with the rim having an outwardly extending lip 22. Located centrally of the base member 18 is a cylindrical boss or stud 24, the end of which is bonded to the cover member 16. The boss, as shown, presents a recessed portion 26 on the side of the base member away from the cover member 16. The boss 24 extends from the base member 18 and in the same direction as the rim 20. A hole or opening 28 is provided in the end wall 30 of the boss 24. A hole 32 is formed in the cover member 16 and is located so it is aligned with the hole 28 in the base member 18 when the cover 16 is fastened to the base member 18. The boss 24 extends from the base member 18 the same distance as the rim 20 allowing the cover 16 to be made from flat sheet material.

The cover 16 is bonded to the base member 18 so that a waterproof bond or seal is made between the rim 20 and lip 22 and the cover 16 and between the cover 16 the central portion of the base member 18 provided by the end wall 30 and the cover 18. The waterproof seal is desired since the markers when used are buried with a utility line so protection is needed for the wire coil 12 and capacitor 14. The material selected for the housing 10 should be waterproof and should not deteriorate when buried in the ground. Any number of plastic materials, such as polyvinylchloride, polyethylene and acrylonitrile-butadiene-styrene are suitable materials for the housing 10. The cover 16 and base member 18 can be bonded together at the portions mentioned above by the use of pressure and vibration to provide the desired waterproof bond or seal. Other known methods and materials that are compatible with the plastic material used for the cover member 16 and base member 18 can be used to provide the desired bond.

The formation of the boss or stud 24 with the recess 26 saves material for making the base member 18 and also reduces the length of any mechanical fastener that may be used to fasten the marker device to the ceiling of a buried utility line vault or to a strip of material buried with the utility line which serves as a warning strip to those who accidentally dig where a utility line is buried. With reference to mounting of the described marker to the ceiling of a utility line vault, a stud gun can be used with the cover member 16 positioned adjacent the ceiling with the passage formed by the holes 28 and 32 used for passage of the stud fastener.

The passive marker devices are usable as passive markers in carrying out the method for locating buried markers as described in U.S. Pat. No. 4,119,908 to Armond Cosman et al.

While the outer periphery of the housing 10 is shown in the drawings as circular, it can be appreciated that other peripheral configurations can be used. Similarly, it can be appreciated that the cover member 16 need not be flat, but can be formed so as to nest within the base member 18. It can also be appreciated that the central portion of the base member 18 can be flat with the cover member 16 having a stud member which makes bonding contact with the central portion of the base member 18.

While there has been described in connection with the drawing what is at present considered to be the preferred embodiment of the invention, it will be understood that various modifications, such as those mentioned above, may be made therein and it is intended to cover in the appended claims all such modifications as fall within the true spirit and scope of the invention.

We claim:

1. A passive marker device including:

a housing including a base member having a central portion and an upstanding rim; and a cover member extending between and bonded to said upstanding rim and said central portion, said base member having an opening in said central portion about which said cover member is bonded and said cover member having an opening aligned with said opening in said central portion; and a tuned circuit positioned within said housing between said central portion and said rim.

2. A passive marker device in accordance with claim 1 wherein said central portion of said base member includes a boss to which said cover member is bonded, said boss extending in the same direction as said rim and having said opening of central portion.

3. A passive marker device in accordance with claim 2 wherein said boss defines a recess on the side of the base member that is away from the cover member.

4. A passive marker in accordance with claim 2 wherein said cover member is formed from flat sheet material and remains flat while bonded to said boss and said rim.

* * * * *